United States Patent [19]

Yamazaki et al.

[11] Patent Number: 4,818,026

[45] Date of Patent: Apr. 4, 1989

[54] SHIELD TYPE TUNNELING APPARATUS

[75] Inventors: Toshihiro Yamazaki; Yoshihito Minami, Both of Osaka, Japan

[73] Assignee: Kabushiki Kaisha Komatsu Seisakusho, Tokyo, Japan

[21] Appl. No.: 138,940

[22] Filed: Dec. 29, 1987

[51] Int. Cl.[4] ..... E21D 9/08; E21D 9/12

[52] U.S. Cl. ..... 299/56; 299/58; 299/67; 405/143

[58] Field of Search ..... 299/56, 49, 58, 64, 299/67, 18, 9, 8, 2; 175/53, 102; 405/141, 143

[56] References Cited

U.S. PATENT DOCUMENTS

| | | | |
|---|---|---|---|
| 3,334,945 | 8/1967 | Bartlett | 299/56 X |
| 3,672,726 | 6/1972 | House | 175/102 X |
| 3,830,545 | 8/1974 | Sugden | 299/56 X |
| 4,165,129 | 8/1979 | Sugimoto et al. | 299/56 X |
| 4,406,498 | 9/1983 | Akesaka | 299/18 X |
| 4,456,305 | 6/1984 | Yoshikawa | 299/56 X |
| 4,629,255 | 12/1986 | Babendererde | 299/56 X |

*Primary Examiner*—Stephen J. Novosad

*Attorney, Agent, or Firm*—Frost & Jacobs

[57] ABSTRACT

A shield type tunneling apparatus comprises: a shield body having in its front portion a cutter-head compartment for digging a tunnel through bedrock, the cutter-head compartment being rotatably driven by a driving unit; and a transporting means for discharging rock debris produced by the cutter-head compartment from a front area thereof to a rear area of the shield body. The tunneling apparatus is characterized in that: the cutter-head compartment is filled with water which buoys up the rock debris in the cutter-head compartment to enable the rock debris to easily enter the transporting means under the influence of rotational movement of the cutter-head compartment.

2 Claims, 2 Drawing Sheets

SHIELD TYPE TUNNELING APPARATUS

BACKGROUND OF THE INVENTION

1. Field of the Invention:

The present invention relates to a shield type tunneling apparatus for digging a tunnel through bedrock.

2. Description of the prior Art:

A conventional shield type tunneling machine comprise a shield body in a front portion of which is provided a hermetic cutter-head compartment in which are provided a plurality of disk-cutter units. In such conventional tunneling machine, the cutter-head compartment is rotatably driven by a driving unit of the machine so as to dig a tunnel through bedrock which is broken by the disk-cutter units. Such broken bedrock forms rock debris which is introduced into the cutter-head compartment through slits provided in a front portion of the cutter-head compartment, and then transported to a rear area of the shiled body through a suitable transporting means such as a screw conveyer and the like.

However, the conventional shield type tunneling machine provided with the hermetic cutter-head compartment lacks an effective means for discharging the rock debris from a front area of the shield body, which makes it substantially impossible to employ the conventional shield type tunneling machine in digging a tunnel through bedrock.

SUMMARY OF THE INVENTION

It is an object of the present invention to provide a shield type tunneling apparatus for digging a tunnel through bedrock, which apparatus is provided with an effective means for discharging rock debris from a front area of a shield body thereof.

It is another object of the present invention to provide a shield type tunneling apparatus in which rock debris introduced into the apparatus is transported to a crusher by means of a screw conveyor and crushed by the crusher into small-sized stones which are effectively discharged through a discharge pipe under the influence of a sucking force exerted by a suitable suction means such as a pump unit disposed in a rear area of the tunneling apparatus.

According to the present invention, there is provided: in a shield type tunneling apparatus comprising: a shield body having its front portion a cutter-head compartment for digging a tunnel through bedrock, said cutter-head compartment being rotatably driven by a driving unit; and a transporting means for discharging rock debris produced by said cutter-head compartment from a front area thereof to a rear area of said shield body; the improvement wherein: said cutter-head compartment is filled with water which buoys up said rock debris in said cutter-head compartment to enable said rock debris to easily enter said transporting means under the influence of rotational movement of said cutter-head compartment.

Further, according to the present invention, there is provided: the shield type tunneling apparatus as set forth in the above, wherein: said transporting means comprising:

(a) a debris-receiving chamber disposed in a central area of said cutter-head compartment;

(b) a screw conveyor a front-end portion of which is provided with a debris-receiving opening disposed in said debris-receiving chamber of said cutter-head compartment, said screw conveyer extending rearward in a longitudinal direction of said shield body and being provided with a debris-discharging opening at its rear-end portion;

(c) at least one water-supply pipe opening into said debris-receiving chamber of said cutter-head compartment at its end, the other end of said water-supply pipe being connected to a water-supply source disposed in a rear area of said tunneling apparatus;

(d) a rock crusher connected to said debris-discharging opening of said screw conveyer, said rock crusher being disposed in said shield body; and (e) at least one debris-discharging pipe connected to said rock crusher at its end, the other end of said debris-discharging pipe being connected to a suction means disposed in said rear area of said tunneling apparatus.

The above and many other advantages, features and additional objects of the present invention will become manifest to those versed in the art upon making reference to the following detailed description and accompanying drawings in which a preferred structural embodiment incorporating the principles of the present invention is shown by way of illustrative example.

DESCRIPTION OF THE PREFERRED EMBODIMENT

A preferred embodiment of the present invention will be hereinbelow described in detail with reference to the accompanying drawings.

Figure 1:
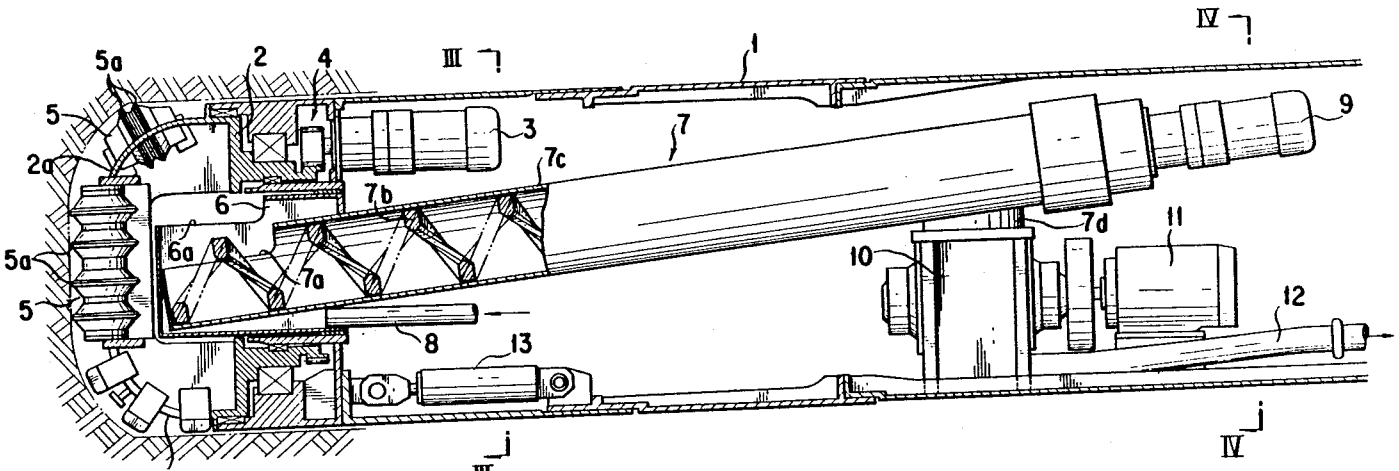
FIG. 1 is a longitudinal sectional view of an embodiment of the shield type tunneling apparatus of the present invention.
Figure 2:
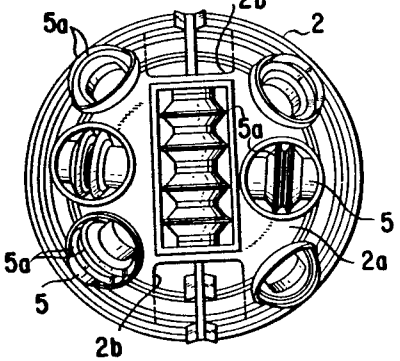
FIG. 2 is a front view of the embodiment of the present invention shown in FIG. 1.
Figure 3:
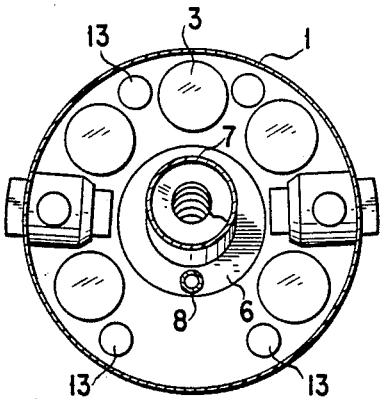
FIG. 3 is a cross-sectional view of the embodiment of the present invention shown in FIG. 1, taken along the line III—III of FIG. 1.
Figure 4:
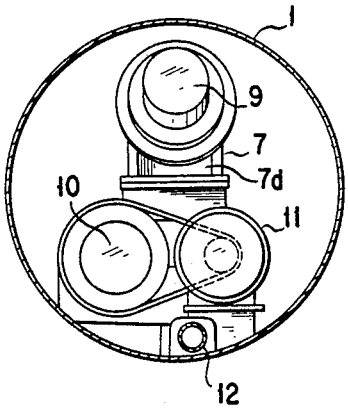
FIG. 4 is a cross-sectional view of the embodiment of the present invention shown in FIG. 1, taken along the line IV—IV of FIG. 1.

In FIG. 1, the reference numeral 1 denotes a shield body of a shield type tunneling apparatus provided with a hermetic cutter-head compartment 2 at its front portion. The cutter-head compartment 2 is rotatably driven by a rotary driving unit 3 through a suitable gear train 4, while provided with a spherical front plate 2*a* in which are mounted a plurality of, for example, seven sets of disk-cutter units 5 each of which is constructed of a plurality of rotary-disk members 5*a* which are so arranged that they travel concentrically with respect to a center of the rotational movement of the cutter-head compartment 2. By means of these rotary-disk members 5*a*, bedrock is broken to produce rock debris which enters the cutter-head compartment 2 through a debris-receiving opening 2*b* provided in the front plate 2*a* of the cutter-head compartment 2.

In a central area of the cutter-head compartment 2 is provided a debris-receiving chamber 6 in which are connected with a front-end portion of a screw conveyer 7 and a front-end portion of a water-supply pipe 8. A rear-end portion of the water-supply pipe 8 is connected to a water-supply source (not shown) disposed in a rear area of the tunneling apparatus. The water is issued from such water-supply source to the debris-receiving chamber 6 through its upper opening 6*a* so that cutter-head compartment 2 is filled with water which buoys up the rock debris to enable the debris to easily enter the debris-receiving chamber 6 through its upper opening 6*a* under the influence of the rotational movement of the cutter-head compartment 2.

The rock debris received in the debris-receiving chamber 6 is transported rearward together with water by means of a screw element 7*b* of the screw conveyer 7 to reach an outlet opening 7*d* of an outer sleeve 7*c* of the screw conveyer 7, and then drops therefrom to a rock crusher 10.

The rock crusher 10 is driven by a driving unit 11 so that rock debris transported by the screw conveyer 7 is crushed therein into small-sized stones which can pass through a debris-discharging pipe 12 connected to the rock crusher 10. The thus crushed debris passes through the debris-discharging pipe 12 together with water under the influence of a sucking force exerted by a suitable suction means such as a pump and the like connected to the other end of the debris-discharging pipe 12, and is discharged in a rear area of the shield body 1 of the tunneling apparatus.

Incidentally, in the drawings, the reference 13 denotes a tunneling-direction control cylinder mounted in the shield body 1 at its front-end portion. Preferably, four control cylinders 4 are mounted in the front-end portion of the shield body 1 at four peripheral section thereof for controlling the tunneling direction of the apparatus.

What is claimed is:

1. Shield type tunneling apparatus comprising a shield body having in its front portion a cutter-head compartment for digging a tunnel through bedrock, said cutter-head compartment being rotatably driven by a driving unit and being filled with water which buoys up rock debris in said cutter-head compartment to enable said rock debris to enter easily a transporting means under the influence of rotational movement of said cutter-head compartment; and transporting means for discharging rock debris produced by said cutter-head compartment from a front area thereof to a rear area of said shield body, said transporting means comprising:

(a) a debris-receiving chamber disposed in a central area of said cutter-head compartment;

(b) a screw conveyor, a front-end portion of which is provided with a debris-receiving opening disposed in said debris-receiving chamber of said cutter-head compartment, said screw conveyor extending rearwardly in a longitudinal direction of said shield body and being provided with a debris-discharging opening at its rear end portion;

(c) at least one water-supply pipe opening into said debris-receiving chamber of said cutter-head compartment at its end, the other end of said water-supply pipe being connected to a water-supply source disposed in a rear area of said tunneling apparatus;

(d) a rock crusher connected to said debris-discharging opening of said screw conveyor, said rock crusher being disposed in said shield body; and (e) at least one debris-discharging pipe connected to said rock crusher at its end, the other end of said debris-discharging pipe being connected to suction means disposed in said rear area of said tunneling apparatus.

2. The apparatus claimed in claim 1, wherein a plurality of tunneling-direction control cylinders is provided in a front-end portion of said shield body at a plurality of peripheral sections thereof.

* * * * *